United States Patent [19]

Tilman et al.

[11] Patent Number: 4,756,629

[45] Date of Patent: Jul. 12, 1988

[54] SYSTEM FOR PRODUCING NON-COMPATIBLE ZIPPER FILM

[75] Inventors: Paul A. Tilman, New City; Joseph Borders, West Nyack, both of N.Y.; Bruce J. Maliner, Edgewater, N.J.

[73] Assignee: Minigrip, Inc., Orangeburg, N.Y.

[21] Appl. No.: 41,309

[22] Filed: Apr. 23, 1987

[51] Int. Cl.[4] ..... B65D 33/16

[52] U.S. Cl. ..... 383/63; 156/66

[58] Field of Search ..... 383/63, 94, 97; 493/214; 156/66; 24/587

[56] References Cited

U.S. PATENT DOCUMENTS

| | | | |
|---|---|---|---|
| 3,904,468 | 9/1975 | Noguchi | 156/244 |
| 4,341,575 | 7/1982 | Herz | 156/66 |
| 4,428,788 | 1/1984 | Kamp | 156/66 |
| 4,654,878 | 3/1987 | Lems | 383/63 |
| 4,691,372 | 9/1987 | Van Erden | 383/63 |
| 4,691,373 | 9/1987 | Ausnit | 383/63 |

*Primary Examiner*—Willis Little

*Attorney, Agent, or Firm*—Hill, Van Santen, Steadman & Simpson

[57] ABSTRACT

A method and apparatus of forming a reclosable bag of flexible film wherein the bag has confronting side walls joined by seams at its edges and confronting rib and groove fastener strips at the top edge with the strips joined to the inner faces of the bag walls by bonding layers which have a predetermined width such that when a spot seal is formed at the ends of the strips, leakage is prevented between said strip ends so that the interconnecting profiles of the strips are sealed in permanent alignment. The flattened melted material of the spot seals is secured to the bag walls by the bonding layer and the predetermined width of the bonding layer is wider than the spot seals.

10 Claims, 1 Drawing Sheet

FIG. 1
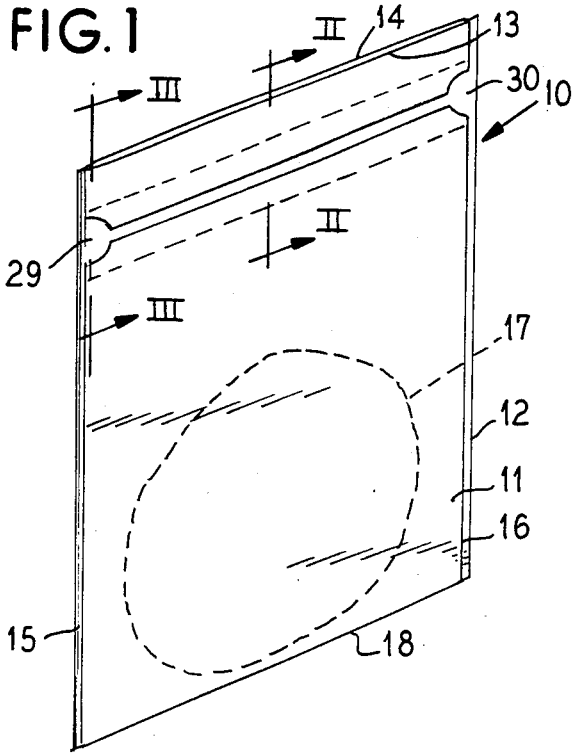
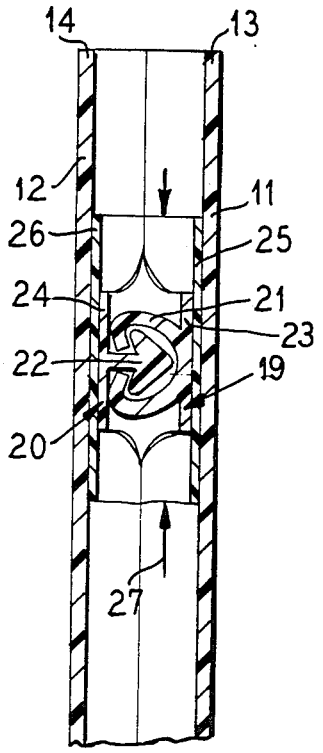
FIG. 2
FIG. 3
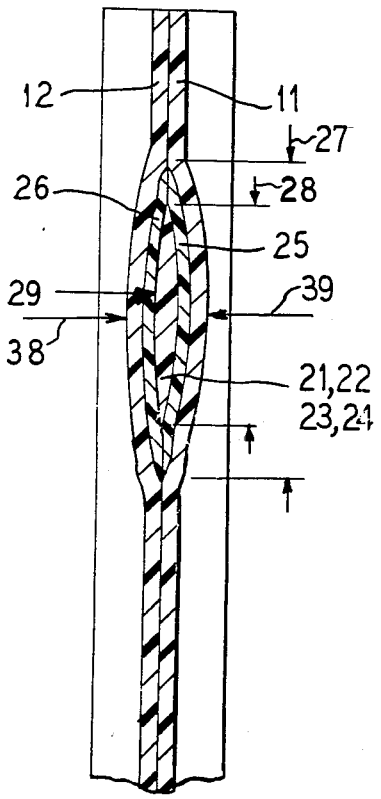
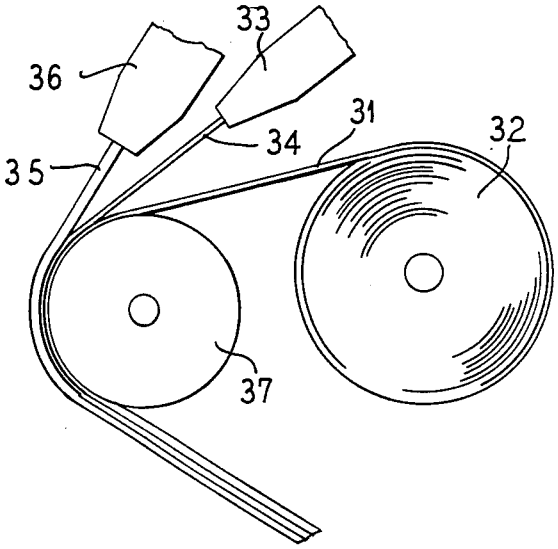
FIG. 4

SYSTEM FOR PRODUCING NON-COMPATIBLE ZIPPER FILM

BACKGROUND OF THE INVENTION

The present invention relates to improvements in reclosable plastic bags, and more particularly to a bag wherein walls are formed of a first material and separate fastener strips of a different material are attached to the inner surfaces of the bag walls adjacent the top of the bag.

Plastic bags, pouches and containers of various types having interlocking pressure-sealable closures are well-known, commercially available items which are currently used for a variety of purposes. The demand for these bags is continuously growing as new uses for them are found, but also growing is the demand for a higher quality product that will reliably protect the contents of the package. Accordingly, great pressure has been placed on manufacturers of such bags to produce them in ever greater quantities while reducing the number of defects that occur in the manufacturing process, so that they are not only more reliable, but more economical to produce. Such containers may be formed in a variety of ways, with each method of forming having its advantages and disadvantages.

In one form of plastic bag, rather than having the fastener profiles integral with the material of the bag, the interlocking profiles are carried on fastener strips which are attached to the bag. This permits the use of a bag material of material characteristics for the bag and profiles of material optimum characteristics for the profiles, which may be quite different from that of the bag material. A problem arises in the manner of attachment of the profile strips to the inner surfaces of the bag wall, particularly when dissimilar materials are used and materials which are thermally incompatible in that the application of heat will not cause a bonding of the profile strip to the bag wall. This may occur when the bag material is multilayered and has a non-thermoplastic inner surface, such as a foil, is presented to the fastener strip. A problem also arises if the bag material has printing or other foreign elements on the inner surface which would interfere with the bonding. One manner of attaching profile strips to plastic is disclosed in U.S. Pat. No. 4,428,788, although the disclosure is limited to bonding by simultaneous coextrusion of the film and the closure device with an intermediate thermoplastic bonding layer. Another manner of attaching profiles to film is shown in U.S. Pat. No. 3,904,468 wherein a bonding with freshly extruded strips is shown and a still further method is illustrated in U.S. Pat. No. 4,341,575 wherein an adhesive is employed.

However, these arrangements have limitations requiring certain types of materials and certain conditions of formation. In the formation of reclosable bags, it has been found that two very important criteria must be met with one being the assurance that there will not be leakage past the fastener strips or profiles at their ends. Another important factor to be satisfied is that the reclosable fasteners be easy to reclose and this requires assurance that the profiles will remain in alignment at their ends so that they can be readily pressed together between the thumb and forefinger or by a slider if one is used.

It is accordingly an object of the present invention to provide a method and structure for a flexible plastic bag having reopenable profiles at the top wherein the fastener strips can be attached to the bag surface under a variety of conditions and the attachment structure be such that leakage at the ends of the profiles is prevented.

A still further object of the invention is to provide a reclosable bag structure utilizing interlocking profiles wherein the profiles are held in alignment at their ends and the structure holding them in alignment does not result in leakage past the fastener strips.

SUMMARY OF THE INVENTION

In accordance with the concepts of the invention, a premade film is used in the making of a bag. The premade film is initially prepared by the attachment of fastener strips along the edge at a location which will correspond with the top of the bag. The edges of the film are attached to form seams at the edges of the bag. A bonding strip is fed or supplied between the fastener strips and the wall of the bag for positive attachment and for mounting the strips on the bag material. This makes it possible to attach non-compatible strip material to non-compatible bag material. By non-compatible is meant plastics or materials which will not join with the usual application of a bonding heat which is a conventional way of joining thermoplastic strips to thermoplastic film material. In structures heretofore available, it was necessary to limit attachment to thermoplastic bonding by feeding a thermoplastic strip between the material at the time when both the film and the fastener were still warm. Other methods heretofore available required the application or the utilization of an adhesive for the materials.

In accordance with the present invention, a bonding material is placed between the strips and film with the bonding layer having a predetermined width. The ends of the interlocked profile strips are then melted together by a spot seal with the application of heat and pressure which absolutely precludes leakage at the ends between the profiles and absolutely orients or positions the profiles with respect to each other so that interlocking profiles are maintained in positive alignment. For example where rib and groove profiles are used, the rib will always remain in the profile at the ends adjacent the spot seal so that when the profiles are pressed together, they will start by joining at the ends and closing is easily and surely accomplished.

The bonding layer is formed of a predetermined width which is wider in a lateral direction than the spot seal which is formed so that the edges of the spot seal securely attach themselves to the bonding layer thereby preventing any gaps or leakage openings from remaining.

Other objects, advantages and features will become more apparent with the teaching of the principles of the invention in connection with the disclosure of the preferred embodiments in the specification, claims and drawings in which:

DESCRIPTION OF THE DRAWINGS

FIG. 1 is a perspective view of a finished bag constructed in accordance with the principles of the present invention;

FIG. 2 is a fragmentary enlarged vertical sectional view taken substantially along line II—II of FIG. 1;

FIG. 3 is an enlarged fragmentary vertical sectional view taken substantially along line III—III of FIG. 1; and FIG. 4 is a somewhat schematic elevational view of a step in the method of attaching the fastener strips.

DESCRIPTION OF THE PREFERRED EMBODIMENTS

As shown on the drawings, a reclosable bag 10 is formed of a flexible plastic material constructed with a front wall 11 and a rear wall 12. The walls have separable edges 13 and 14 at their tops to form an opening for the bag and the sides of the film are joined by side seams 15 and 16. A bottom seam 18 closes the bag for enclosing contents shown schematically by the broken line object 17.

At the top edge of the bag is a reclosable fastener provided by fastener strips attached to and extending along the inner surface of the walls of the bag near the top.

The flexible film of the bag is preformed and the fastener strips are pre-extruded and attached to the film at an appropriate location to be at the top of the bag when the film is made into a double walled bag.

For attachment of the fastener strips, an intermediate bonding strip is placed between the fastener strips and the bag walls to sealingly secure the strips to the walls of the bag.

The strips are shown at 19 and 20 in FIG. 2. The strip 19 has a profile 21 extending therealong with a base 23 to mount the profile on the bag wall.

Similarly, the strip 20 has a profile 22 extending therealong with a base 24 for mounting the profile on the bag wall.

While various forms of reclosable interlocking fasteners may be used, the strips are shown as having interlocking rib and groove elements with the profile 21 being a female element shaped to coactingly receive the male element 22. In a preferred form, the profiles on the base of each of the fastener strips are formed of the same material being a thermoplastic material such as polyethylene having characteristics well suited to rigidity and flexibility for interlocking.

The intermediate bonding layers 25 and 26 are of a material which will adhere to each of the materials of the bag walls and the base of the profiles. In many cases the bag walls will be of a non-thermoplastic material or non-compatible material which will not adhere to the base of the fastener strips with the application of heat. The bonding layers 25 and 26 may be of an adhesive or may be of a thermoplastic which is capable of bonding to both the materials of the fastener strips and the bag walls.

At the ends of the fastener strips for the completed bag, as shown in FIG. 1, spot seals 29 and 30 are formed. The purpose of these spot seals is to form a barrier or a block which will not allow leakage into or out of the bag at the side seams of the bag at the location where the profile strips end. The spot seals 29 and 30 are formed by the simultaneous application of pressure and heat by a suitable tool such as shown schematically at 38 and 39 in FIG. 3. This application melts the thermoplastic of the profiles and fuses it so that it forms a unitary structure at the spot seal. This unitary structure eliminates the possibility of leakage of air past the profiles at the ends of the fastener strips. The unitary spot seals 29 and 30 also maintain the rib and groove elements 21 and 22 in alignment at the ends so that after they are opened by pulling the top edges 13 and 14 of the bag apart, they can be surely and reliably closed with the mere application of pressure along the rib and groove starting at the ends since the rib and grooves will remain joined immediately adjacent the spot seals 29 and 30.

With the application of heat and pressure, the rib and grooves 21 and 22 provide an excess of plastic between the fastener strips which flows together and outwardly to a width 28 as shown by the arrowed lines in FIG. 3. The intermediate bonding strips 25 and 26 have been chosen with a predetermined width 27. This predetermined width 27 is wider than the width 28 of the spot seals so that as the spot seals spread, they are secured to the surfaces of the bonding layers 25 and 26 thereby preventing the possibility of any remaining leakage air passage being formed by the spreading of the plastic of the spot seals. If the intermediate bonding layers 25 and 26 are of thermoplastic, they melt into the plastic of the spot seal to form the bond. If the bonding layers 25 and 26 are of an adhesive material, they will similarly bond to the edges of the spot seal.

Thus, a requirement is that the width of the intermediate bonding layer be wider, in both lateral directions than the width of the spot seal. This, of course, can be predetermined by the amount of plastic present in the rib and groove elements and their bases and the manufacturer will know the width to which the spot seal will spread with the application of the heat and pressure.

FIG. 4 shows the manner of attaching the strips using the intermediate bonding layer. A pre-made or preformed plastic film 31 is fed off a supply roll 32 over a support roll 37. The bonding layer is fed onto the surface of the film at the location required and the bonding layer is shown at 34 being fed from a supply 33. The supply 33 may be an extrusion head if the bonding layer is of a thermoplastic material.

The profile strips 35 are fed over the top of the bonding layer which causes a bonding or an adherence between the film 31 and the strip 35. The strip 35 may be fed from a supply 36, or 36 may represent an extrusion head with the profile being extruded at that location.

The significant feature to be observed in the choosing of the bonding layer 34 is that its width be wider than the spot seals 29 and 30 which will be formed at the ends of the profile strips.

In operation the material is formed as shown at 34, FIG. 4, with a female fastener strip being attached to one layer of film and a male profile strip being attached to another layer of film. The layers of film are then brought together with the fastener strips in alignment so that the rib and groove profiles interlock, and the side seams 15 and 16 and the bottom seam 18 are formed, FIG. 1. Spot seals 29 and 30 are then formed by the application of heat and pressure in the areas illustrated and the spot seals will spread out but at a width not exceeding the width of the bonding strips 25 and 26 and the spread-out or feathered-out edges of the spot seals 29 and 30 will bond and attach themselves to the bonding strip thus preventing any leakage path from remaining.

Thus, it will be seen that we have provided an improved method and apparatus which meets the objectives and advantages above set forth and provides an improved method of making a container and an improved resultant bag.

We claim as our invention:

1. A reclosable container, comprising in combination:

a bag having confronting flat side walls of a thin film and having an opening between said walls at the top of the bag with said walls attached by a side seam at each side of the bag;

reclosable rib and groove fastener strips at the top of the bag between said side walls formed of a thermoplastic material, each strip having an interlocking profile thereon in facing engageable relationship with the opposing profile and having a base secured to the bag wall;

a bonding layer between each of the strips and the bag wall coextensive with the strips and located between said base and said bag wall and having a predetermined lateral width, said width being substantially wider than the profile of the strips;

and a flattened compressed spot seal at each end of the strips formed of a molten juncture of the plastic of the profiles thereby preventing leakage between the profiles at the seal and locking the profiles in interlocked alignment, said spot seal having a width dictated by the width of the amount of spread which occurs in the plastic of the profiles when compressed to form said spot seal, the width of the bonding layer being greater in both directions laterally of the profiles than said spot seal, the edges of the spot seal being joined to the bag wall by said bonding layer.

2. A reclosable container constructed in accordance with claim 1:

wherein the base of each of the strips is formed by a supporting flat strip wider than the profiles.

3. A reclosable container constructed in accordance with claim 2:

wherein one of said profiles is in the form of a rib and the other of the profiles is in the form of a groove complementary shaped to receive the rib.

4. A reclosable container constructed in accordance with claim 1:

wherein the film material of the bag walls and the material of the strips is thermally incompatible and will not join with the application of heat.

5. A reclosable container constructed in accordance with claim 1:

wherein said bonding layer is formed of a thermoplastic adhesively compatible with both the film of the walls and with the strips so that the strips and walls are both adhered to the bonding layer.

6. The method of constructing a reclosable bag of flexible film comprising the steps:

providing a film of bag material to form confronting bag walls;

forming a first wall member of the film by feeding a profile strip onto a first section of the film in a position adjacent the location of an opening for a bag to be formed of the film, said strip having a base and a locking profile extending therealong;

feeding a bonding layer between the film and the base of the strip with the bonding layer having a predetermined width and adhering the bonding layer to both the film and strip so that the strip is secured to the film;

forming a second wall member of the film by feeding a profile strip onto a second section of the film in a position adjacent the location of an opening of a bag formed of the film, said strip having a base and a locking profile extending therealong complementary shaped to the profile of the strip on the first wall member;

feeding a bonding layer between the film and the base of the second strip with the bonding layer having a predetermined width and adhering the bonding layer to both the film and strip so that the strip is secured to the film;

joining the profiles in interlocking relationship;

and applying a localized heat and pressure to the joined profiles at their ends to form a spot seal and spreading the plastic of the profiles against the bonding layer to adhere thereto, the lateral width of said bonding layer being greater than the spot seal so that no leakage can occur between the spot seal and bag walls.

7. The method of constructing a reclosable bag of a flexible film in accordance with the steps of claim 6:

wherein the film and strips are thermally non-compatible so as not to adhere with the application of heat.

8. The method of constructing a reclosable bag of a flexible film in accordance with the steps of claim 6:

wherein said bonding layer is compatible with each of the film and the strip so that the layer will adhere to each.

9. The method of constructing a reclosable bag of a flexible film in accordance with the steps of claim 6:

wherein the bonding layer is of a thermoplastic material.

10. The method of constructing a reclosable bag of a flexible film in accordance with the steps of claim 6:

wherein the strips have a profile and a base and the base is a flattened web and said bonding layer is laterally wider than said web and said spot seals.

* * * * *